US007740501B2

(12) United States Patent
Ballard et al.

(10) Patent No.: US 7,740,501 B2
(45) Date of Patent: Jun. 22, 2010

(54) HYBRID CABLE FOR CONVEYING DATA AND POWER

(75) Inventors: Claudio R. Ballard, 16 W. Neck Ct., Huntington, NY (US) 11743; Andrew P. Sargent, Chittenden, VT (US); Jeffrey N. Seward, Fairfax, VT (US)

(73) Assignee: Claudio R. Ballard, Fort Lauderdale, FL (US)

( * ) Notice: Subject to any disclaimer, the term of this patent is extended or adjusted under 35 U.S.C. 154(b) by 0 days.

(21) Appl. No.: 12/134,454

(22) Filed: Jun. 6, 2008

(65) Prior Publication Data

US 2009/0011639 A1 Jan. 8, 2009

Related U.S. Application Data

(60) Provisional application No. 60/933,358, filed on Jun. 6, 2007.

(51) Int. Cl.
*H01R 9/05* (2006.01)

(52) U.S. Cl. ..... 439/578; 174/105 R

(58) Field of Classification Search ..... 439/578; 361/105 R, 113 R

See application file for complete search history.

(56) References Cited

U.S. PATENT DOCUMENTS

| | | | | |
|---|---|---|---|---|
| 2,180,731 | A | 11/1939 | Dickinson | |
| 3,259,684 | A * | 7/1966 | Wakefield | 174/36 |
| 3,433,891 | A * | 3/1969 | Mackenzie, Jr. et al. | 174/120 R |
| 5,149,915 | A * | 9/1992 | Brunker et al. | 174/36 |
| 5,304,739 | A * | 4/1994 | Klug et al. | 174/102 R |
| 5,557,698 | A | 9/1996 | Gareis et al. | |
| 5,637,933 | A | 6/1997 | Rawlings et al. | |
| 5,745,027 | A | 4/1998 | Malville | |
| 6,182,807 | B1 | 2/2001 | Saito et al. | |
| 6,198,244 | B1 | 3/2001 | Hayden et al. | |
| 6,479,973 | B2 | 11/2002 | Saito et al. | |
| 6,780,047 | B1 | 8/2004 | Laity et al. | |
| 7,004,787 | B2 * | 2/2006 | Milan | 439/502 |
| 7,375,285 | B2 * | 5/2008 | Chiang | 174/113 R |
| 2006/0097852 | A1 | 5/2006 | Lammers et al. | |

FOREIGN PATENT DOCUMENTS

| | | | |
|---|---|---|---|
| DE | 195 26 809 | A1 | 1/1997 |
| DE | 103 11 396 | A1 | 9/2004 |
| DE | 10 2004 053238 | A1 | 5/2006 |
| EP | 0 507 225 | A | 10/1992 |
| EP | 1 493 630 | A | 1/2005 |
| EP | 1 429 348 | A1 | 1/2010 |

OTHER PUBLICATIONS

PCT: International Search Report and Written Opinion of PCT/IB2008/002060 (counterpart application); Feb. 16, 2009; 12 pgs.
PCT: International Preliminary Report on Patentability of PCT/IB2008/002060 (counterpart application); Dec. 7, 2009; 9 pgs.
PCT: International Preliminary Report on Patentability of PCT/IB2008/002056 (related application); Dec. 7, 2009.
PCT: International Search Report and Written Opinion of PCT/IB2008/002056 (related application); Jan. 7, 2009.

* cited by examiner

*Primary Examiner*—Thanh-Tam T Le
(74) *Attorney, Agent, or Firm*—Howison & Arnott, L.L.P.

(57) ABSTRACT

Hybrid cables for conveying data and conducting operating power to electrically powered devices and a vehicle utilizing such cables are disclosed.

17 Claims, 6 Drawing Sheets

HYBRID CABLE FOR CONVEYING DATA AND POWER

CROSS-REFERENCE TO RELATED APPLICATIONS

This application claims benefit of U.S. Application Ser. No. 60/933,358, filed Jun. 6, 2007, and entitled VIRTUAL ELECTRICAL AND ELECTRONIC DEVICE INTERFACE AND MANAGEMENT SYSTEM, which is incorporated herein by reference.

TECHNICAL FIELD

The invention relates to hybrid cables having a first set of electrical conductors for carrying digital signals and a second set of electrical conductors for carrying AC or DC operating power between electrical or electronic devices and, in particular, to hybrid cables for use in carrying digital signals and operating power between spaced-apart devices comprising the electrical system of a vehicle or other artificial structure.

BACKGROUND

Providing a unified network for handling both digital communications and electrical power distribution across the electrical system of a vehicle or other artificial structure is the goal of many developers. The character of the physical connectivity elements connecting the various electrical/electronic devices comprising the networked electrical system is of great interest. Preferably, the physical connectivity elements will facilitate simplified construction, maintenance and modification of the networked electrical system with respect to both the data communications and power distribution aspects.

Conventional vehicle electrical systems, for example, those used in production automobiles, typically distribute electrical power using wiring harnesses featuring dedicated wire circuits running from each discrete electrical/electronic device to its associated power source and/or control switch. Further, most conventional vehicle wiring systems utilize physically separate power conductors and (when needed) signal conductors. Such conventional wiring systems are typically model-specific, feature limited (if any) networking capabilities, and offer no overall control and data collection functions. Thus, such wiring systems are not readily amenable to integrated network communication and power distribution. Furthermore, once production has started, modifying a wiring system utilizing a fixed wiring harness can be very difficult and expensive.

Another drawback of conventional vehicle electrical systems is the widespread practice (especially common in the automotive domain) of using the vehicle's chassis or frame as a common neutral (i.e., ground) connection for electrical circuits. This practice dates back to the early days of automotive development, and has likely been perpetuated for reasons of cost-containment. However, using a vehicle's frame or chassis as a ground or neutral connection may cause problems. First, ground connections to the vehicle's frame or chassis tend to become loose over the life of a vehicle. Such loose ground connections result in voltage drops across the degraded connection, thus interfering with the power distribution aspect of the system. Further, loose ground connections may also generate electromagnetic noise, which may be picked up as "static" by other subsystems in the vehicle, such as the vehicle's radio or sound system. Such electromagnetic noise may also interfere with the operation of network communications if a data network is present on the vehicle.

To the extent that microcontrollers and other electrical/electronic components are currently interconnected in vehicles, the interconnection is typically done via either device-specific local busses (e.g., across an instrument panel), or through proprietary low-rate busses such as those utilizing the Controller Area Network (CAN) protocol. Such interconnections are expensive to engineer and typically rely on proprietary architecture and software. Further, they are not generally capable of supporting integrated diagnostics, fault detection and maintenance related data collection due, at least in part, to limited data transmission rates.

In order to better integrate the numerous electrical devices, sensors and controls used in modern vehicles into a network, higher data transmission rates are required. Better data transmission rates may also allow individual devices to be sequentially connected, (e.g., "daisy chained") together for high level control and monitoring with a host computer. Also, the elimination of electromagnetic noise is important in order to achieve the desired data transmission rates.

Although the high-speed networking of computers is well known using standard networking physical connectivity methods such as "Ethernet over twisted pair," including the widely used 10Base-T, 100Base-T and 1000Base-T (Gigabit Ethernet) methods, these physical connectivity solutions are inadequate for networking the majority of electrical/electronic devices comprising the electrical system of vehicles, e.g., production automobiles. This is because they generally cannot fulfill the power distribution aspect. For example, the Category 5, 5e and 6 cable typically used for 10Base-T, 100Base-T and 1000Base-T physical connectivity has inherently limited electrical power capacity that is insufficient to reliably handle high-current devices found in vehicles, e.g., automotive DC electric motors, electromagnetic clutches, solenoids, lighting, etc. Even enhanced power-delivery schemes such as Power Over Ethernet (POE) cannot typically supply sufficient power for vehicle-wide networking of the electrical system.

Thus, there exists a need for a hybrid cable that provides physical connectivity in a networked electrical system and fulfills both the data communications aspect and the power distribution aspect of the networked system.

SUMMARY

In one aspect thereof a hybrid cable includes a signal conducting core having at least one twisted pair of signal conductors. First and second braided metallic power conductors are circumferentially disposed around the signal conductors with an insulating layer disposed between the power conductors. An outer insulating cover is disposed around the first and second braided metallic power conducting layers and core. A first connector disposed on an end of the cable includes one of a connecting pin or receptacle having a contact for each of the signal conductors and a power contact connected to each of the braided metallic power conductors. In one variation, the hybrid cable includes two twisted pairs of signal conductors and can convey up to 10 Mbits/sec or up to 100 Mbits/sec of data. In another variation, the hybrid cable includes four twisted pairs of signal conductors that can convey up to 1000 Mbits/sec of data. The signal conducting core may include one of an insulating material or strengthening members disposed inside the first power conductor and wherein the twisted pair signal conductors are disposed in the core. The hybrid cable may further include a second connector disposed on a second end of the cable wherein the first braided power conductor, second braided power conductor and twisted pair signal conductor each extend continuously from the first connector to the second connector.

In another variation, a hybrid cable includes at least one twisted pair of signal conductors with a metallic shield disposed around the signal conductors. First and second metallic power conductors are disposed substantially parallel to the signal conductors with an outer insulating cover disposed around the signal conductors, metallic shield and the power conductors. A connector disposed on a first end of the cable includes one of a connecting pin or receptacle for each of the signal conductors and contact connected to each of the power conducting layers. In one variation, the hybrid cable includes two twisted pairs of signal conductors wherein the signal conductors can convey up to 10 Mbits/sec of data. In another variation, the hybrid cable includes four twisted pairs of signal conductors and wherein the signal conductors can convey up to 1000 Mbits/sec of data. The cable may include a second connector disposed on a second end of the cable wherein the first metallic power conductor, second metallic power conductor and twisted pair signal conductor each extend continuously from the first connector to the second connector.

In another aspect, a vehicle having an electrical system including electrically operated sensors and electrically powered devices includes at least one hybrid cable having signal conductors for conveying data and power conductors for conducting power wherein the signal conductors can convey up to 10 Mbits/sec of data. An outer cover is disposed over the signal conductors and power conductors and a plurality of electrically powered devices are sequentially connected by means of the hybrid cable.

BRIEF DESCRIPTION OF THE DRAWINGS

For a more complete understanding, reference is now made to the following description taken in conjunction with the accompanying Drawings in which.

DETAILED DESCRIPTION

Figure 1A:
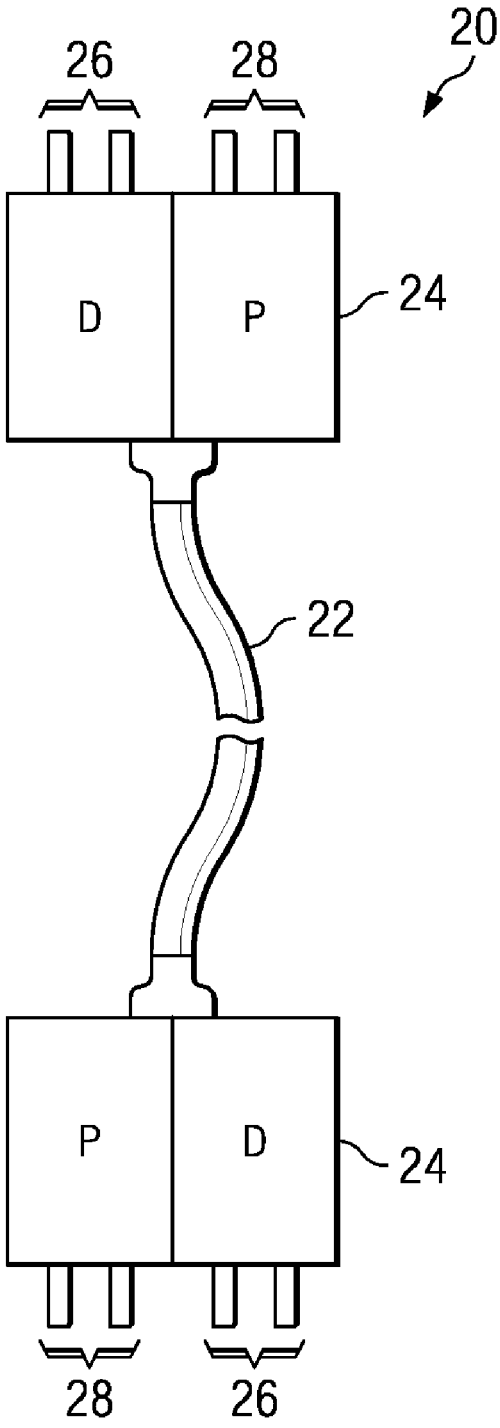
FIG. 1*a* is a schematic view of a hybrid cable in accordance with the disclosure.

Referring now to the drawings, wherein like reference numbers are used herein to designate like elements throughout, the various views and embodiments of a hybrid cable for conveying data and power are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to FIG. 1*a*, there is illustrated a schematic view of a hybrid cable 20 adapted for carrying both digital signals and electrical power across the networked electrical system of a vehicle or other artificial structure in accordance with the disclosure. For purposes of this application, the term "vehicle" may refer to any movable artificial structure including, but not limited to, automobiles, trucks, motorcycles, trains, light-rail vehicles, monorails, aircraft, helicopters, boats, ships, submarines and spacecraft. The term "other artificial structures" may refer to non-movable artificial structures including, but not limited to office buildings, commercial buildings, warehouses, residential multi-family buildings and residential single family homes.

The hybrid cable 20 includes a cable portion 22 including a first set of internal conductors (e.g., conductors 114 in FIG. 2*a*) for carrying digital data and a second set of internal conductors (e.g., conductors 104, 108 of FIG. 2*a*) for carrying electrical power (electrical current and voltage). A connector member 24 is provided at each end of the cable portion 22. Each connector member 24 includes a plurality of first electrical terminals 26 mounted thereon that are operatively connected to each of the first set of internal conductors and a plurality of second electrical terminals 28 mounted thereon that are operatively connected to each of the second set of internal conductors. It will be appreciated that the first electrical terminals 26 and second electrical terminals 28 on one connector member 24 are in continuous electrical contact with the respective first and second electrical terminals on the other connector member, thus allowing the cable 20 to carry data signals from terminals 26 on one end to terminals 26 on the other end, and to carry electrical power from terminals 28 on one end to terminals 28 on the other end. In some embodiments, the hybrid cable 20 may include a water-resistant connector (not shown) that meets a particular ingress protection standard (e.g., qualifies as an IP-67 or similar level protection seal) that provides a rugged interface to the connected network device.

The electrical power carried by the power conductors and power terminals 28 of hybrid cable 20 may be in the form of either DC current or AC current at a desired voltage or voltage range. For example, some hybrid cable implementations may only need to support twelve volt DC power applications, while other implementations may require higher voltages, e.g., twenty-four volts DC, forty-eight volts DC, or 110/220 VAC at 50/60 Hz, etc. In some embodiments, the voltage/power rating of the hybrid cable is identified by the use of color coded cable portions 22 or connector members 24 and/or differently configured and keyed connector members 24 and/or terminals 26, 28 to eliminate the possibility of connecting equipment that is not power compatible.

As described further below, in some embodiments the data conductors and data terminals 26 of the hybrid cable 20 are configured to support one or more high-speed network communication protocols. For example, the hybrid cable 20 may support various levels of Ethernet (e.g., 10baseT, 100baseT, and 1000baseT). Other embodiments may support protocols such as the Universal Serial Bus (USB) protocol, Firewire, CAN, and Flexray in addition to or as alternatives of Ethernet. In still other embodiments, the connector members 24 may be manufactured to aerospace standards from a corrosion resistant material with a temperature rating suitable for harsh application environments. In still further embodiments, the cable portion 22 may have a matching jacket and may be jacketed with shielding sufficient to maintain crosstalk or other noise at a level that will not interfere with network data traffic.

In some versions, the hybrid cable 20 integrates neutral wiring into a single cable concept to prevent ground loops, reduce noise, and improve reliability. As previously discussed, cars, boats, airplanes, and similar environments have traditionally used the vehicle's metal chassis as a return path for the DC operating voltage. This is done mainly as a cost saving measure, but can lead to downstream failures. For example, the electrical connections to ground can be at different galvanic potentials depending on the finish and composition of the materials used, and this can accelerate corrosion in an already hostile operational environment. The electrical resistance of circuits can vary over time, leading to varying voltages running through the same common ground, which often induces electrical noise between circuit paths. Accordingly, using the hybrid cable 20 as disclosed herein minimizes or eliminates these problems due to the cable's configuration as a protected ground wire with gas tight, high reliability connections designed to isolate the electrical circuit return path and minimize or eliminate induced electrical cross talk.

Figure 1B:
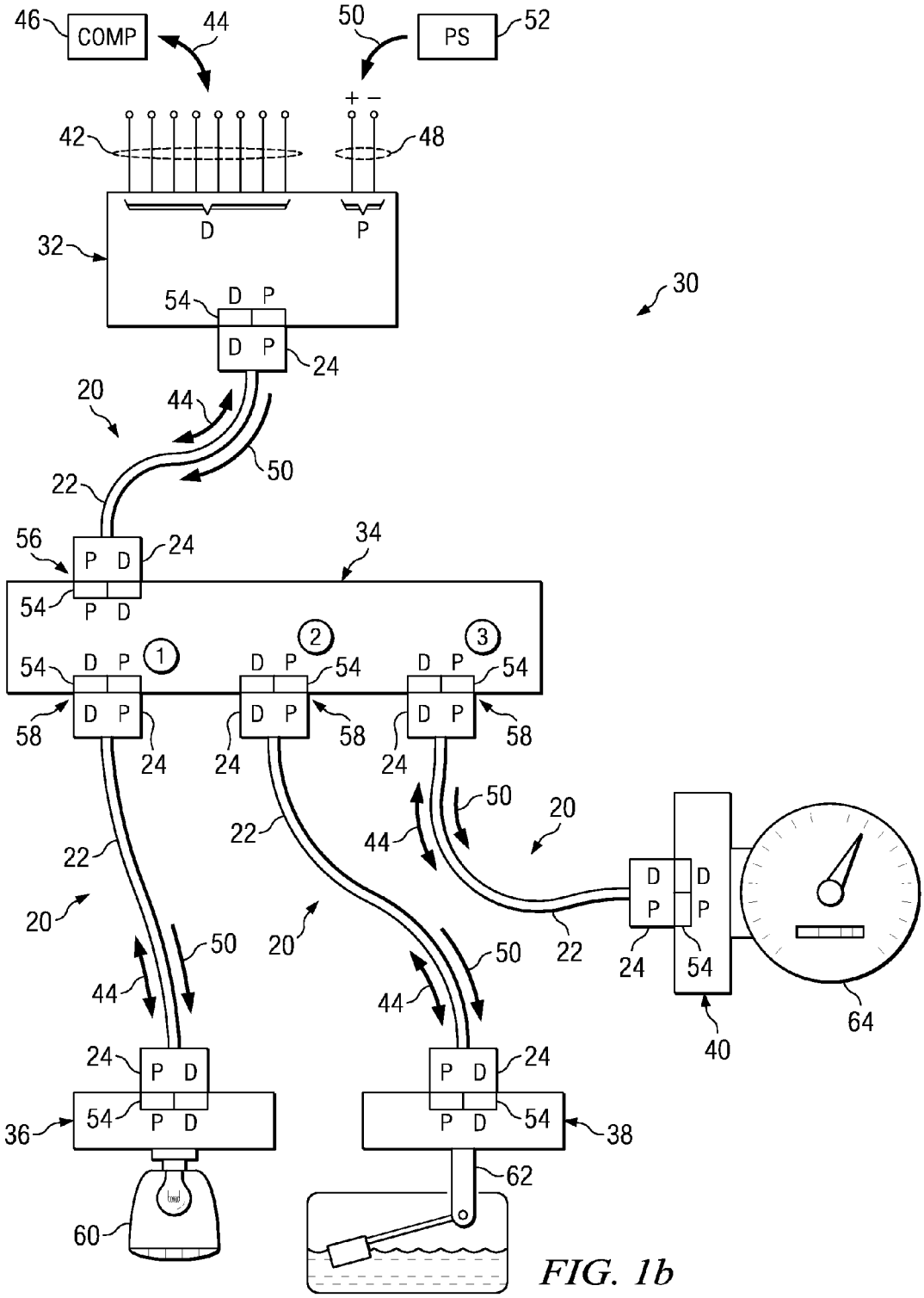
FIG. 1*b* is a schematic view of the hybrid cables of FIG. 1*a* providing physical connectivity in the networked electrical system of a vehicle.

Referring now to FIG. 1*b*, there is illustrated a schematic view of hybrid cables 20 providing physical connectivity in a networked electrical system of a vehicle. In this embodiment, electrical system 30 includes a network controller 32, a hybrid data/power switch 34, and three device modules 36, 38 and 40. The controller 32 has a plurality of data terminals 42 for two-way communication with a computer 46 or other control device via digital data signals 44. The controller 32 also includes a plurality of power terminals 48 for receiving electrical power 50 from a power source 52. The controller further includes a cable interface 54 including some terminals for transmitting/receiving digital data signals 44 and other terminals for sending electrical power 50. The switch 34 includes an input port 56 and three output ports 58, each port including a cable interface 54 including some terminals for transmitting/receiving digital data signals 44 and other terminals for receiving (in the case of the input port) or sending (in the case of the output ports) electrical power 50. Each device module 36, 38, 40 is operatively connected to an electrical/electronic device, in this case a light 60, gas gauge sender 62 and a speed indicator 64, respectively, to provide a low-level interface allowing the network controller 32 to monitor and operate the devices 60, 62 and 64.

Referring still to FIG. 1*b*, hybrid cables 20 are connected between the cable interfaces 54 of each network component 32, 34, 36, 38 and 40. The physical configuration of the cable interface 54 is selected to interfit with the end members 24 of the hybrid cable 20 so as to provide electrical continuity between the appropriate data or power terminals of the devices at each end of the cable 20. This provides physical connectivity across the network for both the digital data communication aspect and the power distribution aspects of the network, i.e., allowing data communication signals 44 to pass back and forth from the controller 32, through the switch 34, to the device modules 36, 38 and 40 (and back) while simultaneously allowing electrical power to be distributed from the controller, through the switch, to the device modules and ultimately supplied to device 60, 62 and 64 for their operation.

Figure 2A:
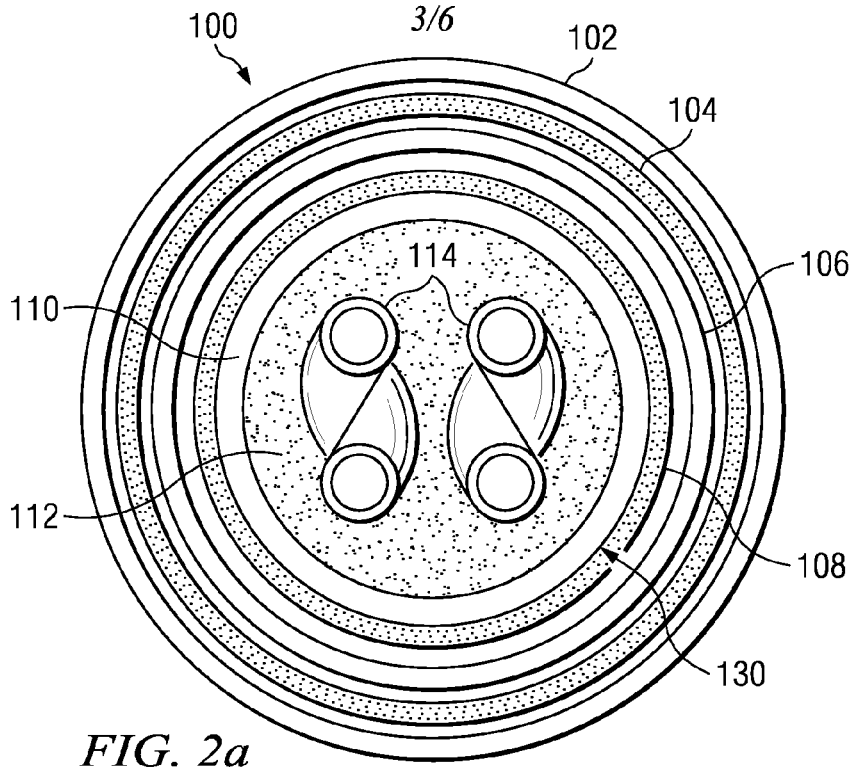
FIG. 2*a* is a cross section of a hybrid cable according to the disclosure.

Referring now to FIG. 2*a*, there is illustrated a cross sectional view of the cable portion of another hybrid cable according to the disclosure. As illustrated, cable 100 includes an outer covering 102 which may be formed of a suitable plastic such as polyethylene, polyvinyl chloride or Teflon®. A first power conductor 104 is disposed inside cover 102. In one variation, the power conductor 104 is a braided metallic sheath that extends around an internal circumference of cable 100 beneath cover 102. An insulating layer 106 is disposed beneath first braided conductor 104. A second power conductor 108 is disposed axially beneath insulating layer 106. In one variation, second power conductor 108 comprises a second braided metallic sheath that extends around an internal circumference of cable 100 beneath insulating layer 106. A core 130 is positioned inside of second power conductor 108. In one variation, core 130 includes a cover 110, which may be formed from a suitable plastic. The use of two power conductors eliminates the need for grounding electrically powered devices to the vehicle's frame or body since one of power conductors 104, 108 will provide a neutral or ground connection.

Disposed in core 130 are twisted pair signal conductors 114. In the illustrated embodiment, two twisted pair signal conductors 114 are illustrated; however, in other variations a single twisted pair signal conductor may be used or more than two twisted pair signal conductors may be used. The twisted pair configuration is used for the purpose of reducing cross talk that may occur when pulsing direct current goes through the conductors, creating electric-magnetic induction effects. Two twisted pairs of signal conductors are capable of conveying 10 Mbits/sec. or 100 Mbits/sec. of data using 10BASE-T or 100Base-T physical connectivity. Four twisted pair of signal conductors may be used to convey up to 1000 Mbits/sec with 1000Base-T physical connectivity. In one variation, an insulating material 112 is disposed around twisted pair signal conductors 114 in core 130.

As used herein, the term "power conductor" refers to a conductor that conveys operating current to devices such as fan motors, windshield wiper motors, vehicle headlights, tail lights, turn signals and similar electrically powered devices. Thus, vehicle power conductors may carry, for example 1 amp or more of electrical current. Alternatively, the term "signal conductor" refers to conductors that use small electrical signals to convey data, such as device addresses, sensor readings and control signals. Currents flowing through signal conductors are typically in the milliamp range. Consequently the current flowing through a power conductor may be on the order of 1000 to 100,000 times greater that the current flowing through a signal conductor.

Figure 2B:
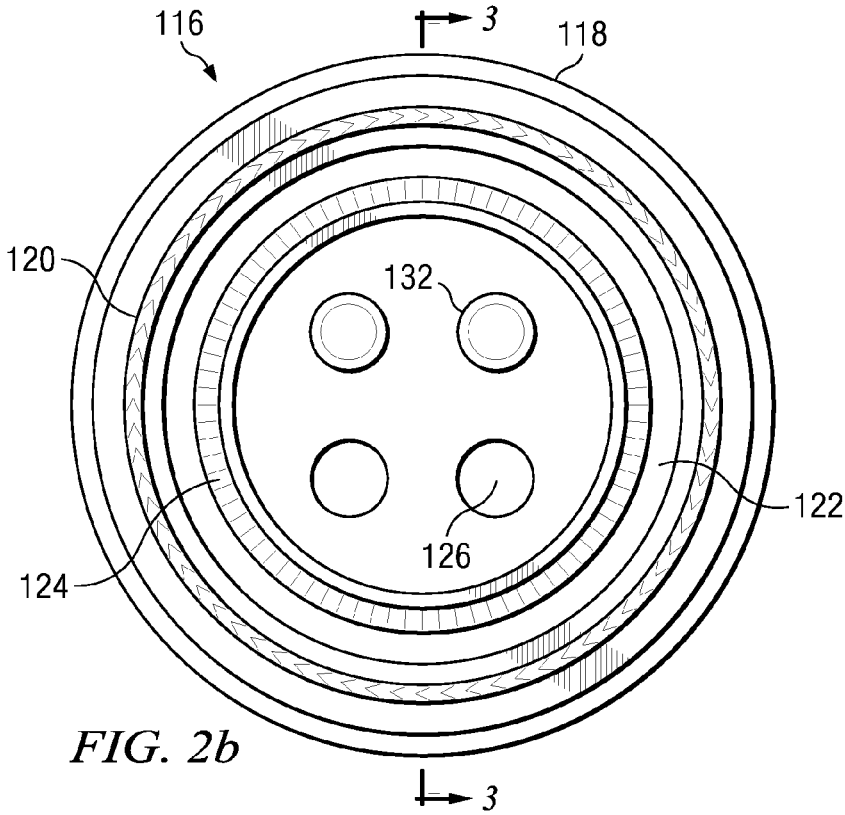
FIG. 2*b* is an end view of a connector for use with the cable of FIG. 2*a;*

FIG. 2*b* is an end view of a connector for use with cable 100. Connector 116 includes a housing 118 that may be formed from a suitable non-conductive material. As illustrated, a circular metallic blade or prong 120 is mounted in housing 118. Blade 120 is connected to first power conductor 104 and provides a path for current flow through the power conductor. Blade 120 is configured for insertion into a mating or complementary recess in a second connecter or receptacle. In the illustrated embodiment, blade 120 extends continuously around an internal circumference of housing 118. In other variations, blade 120 may extend partially around the internal circumference of housing 118, or may be divided into a plurality of individual contacts positioned at spaced-apart intervals.

An annular recess 122 is formed in housing 118 radially inward of blade 120. A contact 124 mounted in recess 122 is connected to second power conductor 108. Contact 124 provides an electrical contact for connecting second power conductor 108 to a mating connector. In the illustrated embodiment, a single circular contact 124 extends around the circumference defined by annular recess 122. In other variations, a single contact 124 that extends only partially around the circumference of recess 122 may be utilized or a plurality of contacts 124 may be spaced apart at intervals around the circumference of recess 122. Contact 124 is connected to second power conductor 108.

Figure 3:
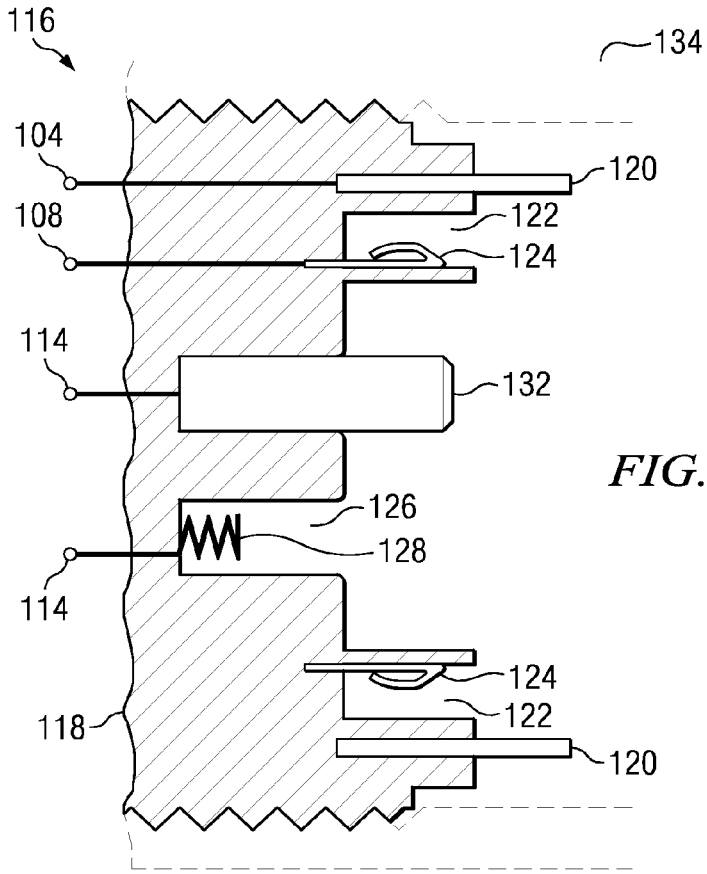
FIG. 3 is a length-wise sectional view of the connector of FIG. 2*b* taken along line 3-3 of FIG. 2*b;*

FIG. 3 is a length wise sectional view of connector 116 taken along line 3-3 of FIG. 2*b*. In one variation, an internally threaded metal collar 134 may be used over housing 118 to couple connector 116 to a mating connector and to provide additional protection to the connector. As illustrated, connector pins 132 and pin receptacles 126 are positioned radially inside annular recess 122 in connector 116. Contacts 128 are positioned inside pin receptacles 126. Pins 132 and contacts 128 provide a signal path through connector 116. A pin 132 and contact 128 may be each connected to a conductor of twisted pair 114. In one variation, a pin 132 and receptacle 126 may be provided for each twisted pair signal conductors 114 in cable 100.

As will be appreciated, hybrid cable assembly 100 provides an integrated means of conveying power and data. Power is conveyed over power conductors 104 and 108, while data and/or control signals are conveyed over twisted pair conductors 114. Power conductors 104 and 108 shield twisted pair signal conductors 114 from electro-magnetic effects, enhancing data transmission.

Figure 4:
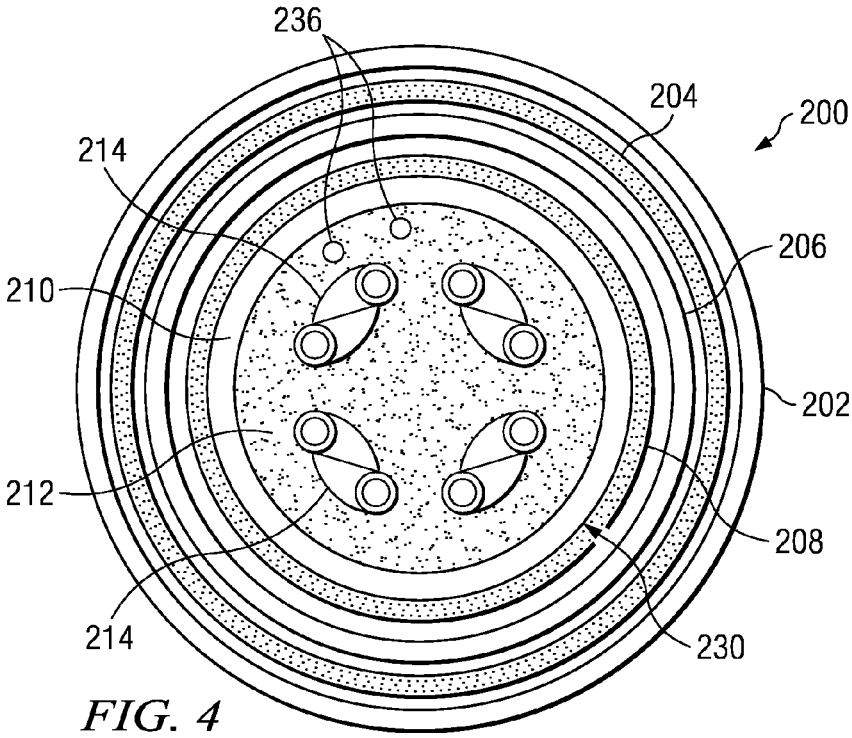
FIG. 4 is a cross sectional view of a first alternate embodiment of a hybrid cable according to the disclosure.
Figure 5:
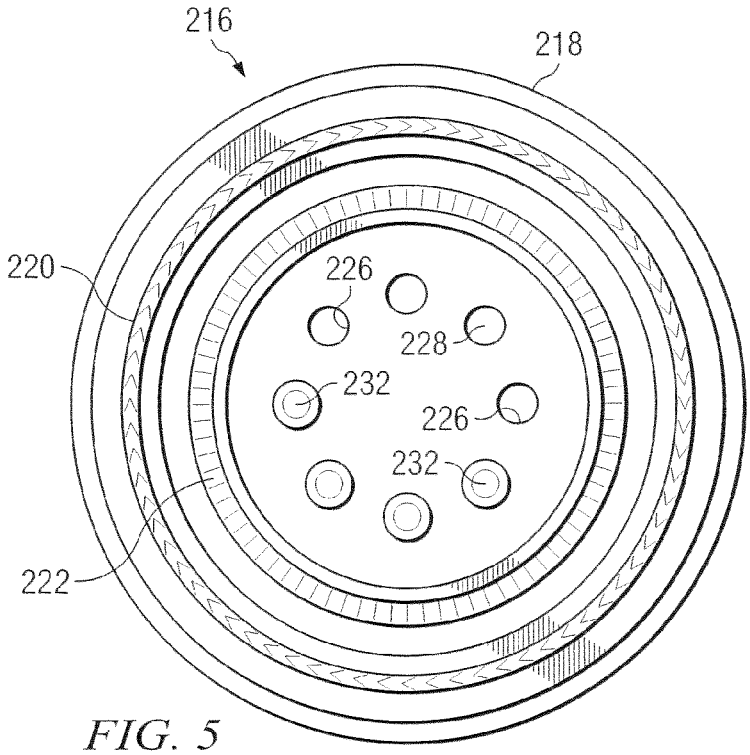
FIG. 5 is an end view of a connector for use with the hybrid cable in FIG. 4.

FIG. 4 is a cross sectional view of an alternate embodiment of a hybrid cable according to the disclosure. FIG. 5 is an end view of a connector for use with cable 200 of FIG. 4. Similar to the embodiment shown in FIGS. 1-3, cable 200 (shown in FIG. 4) includes a cover 202, a first power conductor 204 an insulating layer 206 and a second power conductor 208. First and second power conductors 204, 208 may be braided metal sheaths. Disposed radially within second conductor 208 is a core 230. Core 230 may include a cover 210 formed from a suitable non-conductive material. Positioned within core 230 are four twisted pair signal conductors 214. Core 230 may also include insulating material 212 disposed around twisted pair signal conductors 214. In one variation, core 230 may include strengthening members 236 to enhance the strength of cable assembly 200 and provide further protection for twisted pair conductors 214. Strengthening members 236 may be formed from wire, plastic filaments or strands and/or other suitable fibers.

Referring to FIG. 5, connector 216 is similar in structure to connector 116 shown in FIGS. 2*b* and 3. Housing 218 is similar to housing 118, blade 220 is similar to blade 120, and contact 222 is similar to contact 124. Twisted pair signal conductors 214 are connected to pins 232 and contacts 228 in pin receptacles 226 in the same manner as previously described in connection with the embodiment shown in FIGS. 1-3. A metallic or plastic shield or cover (not shown), similar to collar 134 of FIG. 3 may be provided to couple connector 216 to a mating connector or receptacle and to provide protection for the connection.

Figure 6:
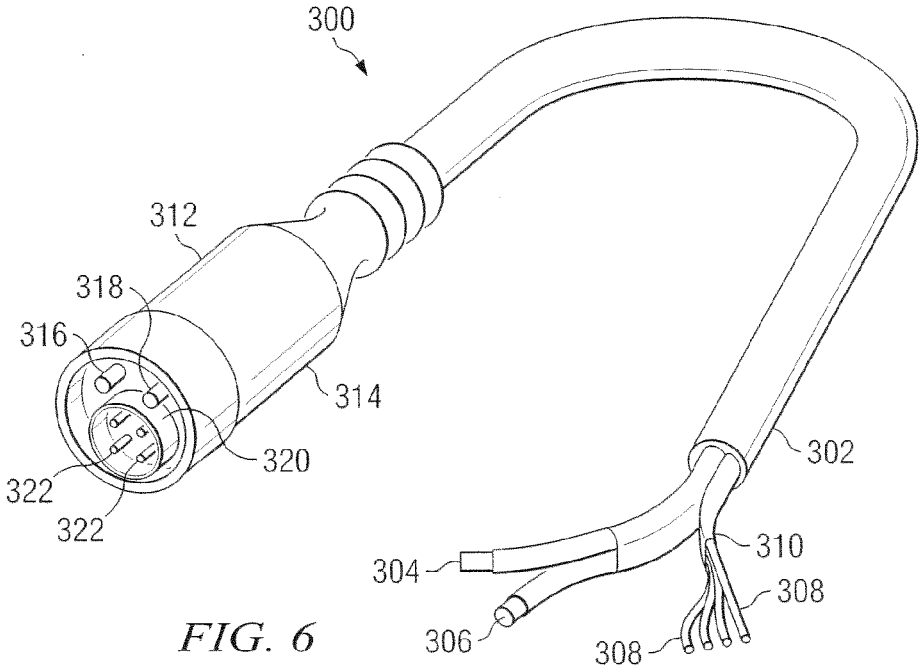
FIG. 6 is a partial perspective view of a second alternate embodiment of a hybrid cable according to the disclosure.

FIG. 6 is a perspective view of a second alternative hybrid cable according to the disclosure. As illustrated, hybrid cable 300 includes a cover 302, which may be formed from a suitable plastic such as polyvinylchloride, polyethylene and/or Teflon®. In one variation, a male connector 312 is mounted on an end of hybrid cable 300. As illustrated, connector 312 includes housing 314, first and second power prongs 316 and 318 that are connected to power leads or conductors 304 and 306 respectively. Connector 312 also includes a plurality of signal transmission pins 322 mounted inside of a metallic shield 320. Pins 322 are connected to signal conductors 308, which may be twisted pair conductors similar to those shown in FIG. 1. In one embodiment, signal conductors 308 are encased in a braided metal sheath 310 which is connected to shield 320 for the purpose of shielding the conductors from electro-magnetic interference. Power conductors 304, 306 along with signal conductors 308 are encased in cover 302. Hybrid cable 300 provides for both power and data transmission over a single integrated cable. In the illustrated embodiment, four twisted pair signal conductors 308 are illustrated; however, a lesser or greater number may be used. The use of four twisted pair signal conductors allows for 1,000Base-T physical connectivity.

Figure 7:
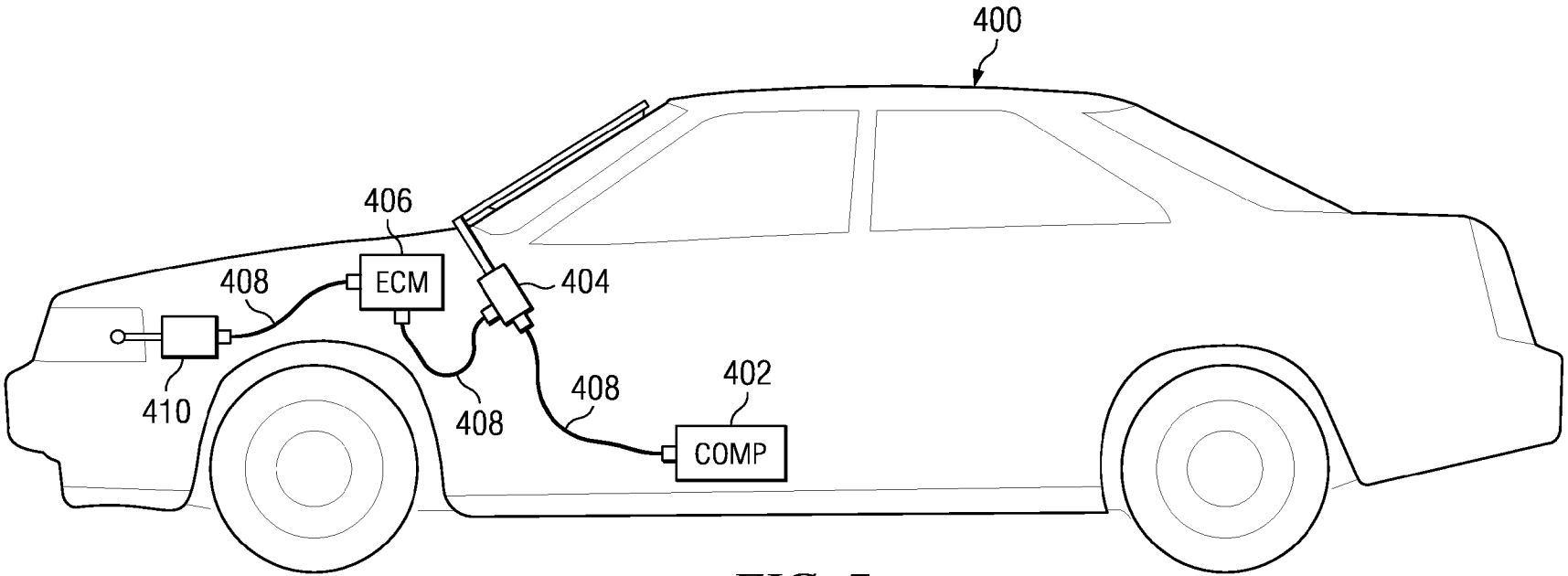
FIG. 7 is a schematic representation of a vehicle utilizing hybrid cables according to the disclosure.

FIG. 7 is a schematic representation of a vehicle 400 utilizing hybrid cables according to the disclosure. In one variation, a host computer 402 is provided for controlling electrical equipment and for receiving and processing inputs from various sensors located on the vehicle. In one variation, hybrid cables 408, similar to those described in connection with FIGS. 1*a*, 4 and 6 are used to connect host computer 402 to various devices and sensors. For example, cables 408 may be used to connect host computer 402 to a windshield wiper motor 404, an engine control module 406 and to headlights 410. The use of hybrid cables 408 enables these devices to be sequentially connected in a "daisy chain," thereby eliminating the need for separate wiring for each device. Each device may provided with a network adapter and/or be assigned a unique address, such as a Media Access Control (MAC) or Ethernet Hardware Address (EHA) for the purpose of identifying signals originating from or conveyed to the device. Other devices that may be connected to host computer 402 utilizing hybrid cables 408 include pressure and temperature sensors, passenger presence sensors mounted in the vehicle seats, flow meters and level sensors that monitoring the amount of fuel in the vehicle's tank and the flow of fuel to the vehicle's engine. Data conveyed over hybrid cables may be used to monitor and collect information reflecting the operation and performance of the vehicle while simultaneously providing operating power for electrically powered devices.

It will be appreciated by those skilled in the art having the benefit of this disclosure that this hybrid cable for conveying data and power provides a hybrid cable for conveying power and data that is adapted for use in vehicles such as automobiles. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A hybrid cable comprising:

a signal conducting core including at least one twisted pair of signal conductors;

a first braided metallic power conductor circumferentially disposed around the signal conductors;

a second braided metallic power conductor circumferentially disposed between the first braided metallic power conductor and the signal conducting core;

an inner insulating layer disposed between the first and second braided metallic power conductors;

an outer insulating cover disposed around the second braided metallic power conducting layer; and a first connector disposed on an end of the hybrid cable, the first connector including one of a connecting pin or receptacle having a contact for each of the signal conductors and a power contact connected to each of the braided metallic power conductors.

2. The hybrid cable of claim 1 further comprising two twisted pairs of signal conductors.

3. The hybrid cable of claim 2 wherein the signal conductors can convey 10 Mbits/sec of data.

4. The hybrid cable of claim 2 wherein the signal conductors can convey 100 Mbits/sec of data.

5. The hybrid cable of claim 1 further comprising four twisted pairs of signal conductors.

6. The hybrid cable of claim 5 wherein the signal conductors can convey 1000 Mbits/sec of data.

7. The hybrid cable of claim 1 wherein the signal conducting core further comprises one of an insulating material or strengthening members disposed inside the first power conductor and wherein the twisted pair signal conductors are disposed in the core.

8. The hybrid cable of claim 1 further comprising a second connector disposed on a second end of the hybrid cable and wherein the first braided power conductor, second braided power conductor and twisted pair signal conductor each extend continuously from the first connector to the second connector.

9. A hybrid cable comprising:

a signal conducting core including at least one twisted pair of signal conductors, the signal conducting core further comprising one of an insulating material or strengthening members and wherein the twisted pair signal conductors are disposed in the core;

a metallic shield disposed around the signal conductors:

a first braided metallic power conductor circumferentially disposed around the signal conductors;

a second braided metallic power conductor circumferentially disposed between the first braided metallic power conductor and the signal conducting core;

an outer insulating cover disposed around the signal conductors, metallic shield and the power conductors;

a connector disposed on an end of the hybrid cable, the connector including one of a connecting pin or receptacle for each of the signal conductors and a contact connected to each of the power conducting layers.

10. The hybrid cable of claim 9 further comprising two twisted pairs of signal conductors and wherein the signal conductors can convey 10 Mbits/sec of data.

11. The hybrid cable of claim 10 wherein the signal conductors can convey 100 Mbits/sec of data.

12. The hybrid cable of claim 9 further comprising four twisted pairs of signal conductors and wherein the signal conductors can convey 1000 Mbits/sec of data.

13. The hybrid cable of claim 9 further comprising a second connector disposed on a second end of the hybrid cable and wherein the first metallic power conductor, second metallic power conductor and twisted pair signal conductor each extend continuously from the first connector to the second connector.

14. A vehicle comprising:

a body;

a plurality of uniquely addressable subsystems, the subsystems connected by an electrical system;

the electrical system including a plurality of electrically operated sensors and a plurality of electrically powered devices and at least one hybrid cable having signal conductors for conveying data and power conductors for conducting power and wherein the signal conductors can convey 10 Mbits/sec of data, at least some of the plurality of electrically operated sensors and electrically powered devices being sequentially connected;

wherein the hybrid cable comprises:

a signal conducting core including at least one twisted pair of signal conductors;

a first braided metallic power conductor circumferentially disposed around the signal conductors;

a second braided metallic power conductor circumferentially disposed between the first braided metallic power conductor and the signal conducting core;

an inner insulating layer disposed between the first and second braided metallic power conductors;

an outer insulating cover disposed around the second braided metallic power conducting layer;

a first connector disposed on an end of the hybrid cable, the first connector including one of a connecting pin or receptacle having a contact for each of the signal conductors and a power contact connected to each of the braided metallic power conductors; and wherein at least some of the plurality of electrically powered devices and electrically operated sensors are sequentially connected by means of the hybrid cable.

15. The vehicle of claim 14 further comprising a second connector disposed on a second end of the hybrid cable and wherein the first braided metallic power conductor, second braided metallic conductor and twisted pair signal conductor each extend continuously from the first connector to the second connector.

16. The vehicle of claim 14 wherein the signal conductors can convey 100 Mbits/sec of data.

17. The vehicle of claim 14 further comprising four twisted pairs of signal conductors and wherein the signal conductors can convey 1000 Mbits/sec of data.

* * * * *